US006286829B1

(12) United States Patent
Emmrich

(10) Patent No.: US 6,286,829 B1
(45) Date of Patent: Sep. 11, 2001

(54) DEVICE FOR COLLECTING AND ALIGNING A STACK OF SHEETS OF A RECORDING MEDIUM

(75) Inventor: Tilo Emmrich, Dietingen (DE)

(73) Assignee: BDT Buro, Rottweil (DE)

( * ) Notice: Subject to any disclaimer, the term of this patent is extended or adjusted under 35 U.S.C. 154(b) by 0 days.

(21) Appl. No.: 09/405,121

(22) Filed: Sep. 24, 1999

(30) Foreign Application Priority Data

Sep. 26, 1998 (DE) ..... 198 44 232

(51) Int. Cl.[7] ..... B65H 31/26
(52) U.S. Cl. ..... 271/220; 271/314
(58) Field of Search ..... 271/220, 221, 271/314

(56) References Cited

U.S. PATENT DOCUMENTS 3,847,388 * 11/1974 Lynch ..... 271/220
5,120,047 * 6/1992 Mandel et al. ..... 271/220
5,743,520 * 4/1998 Barthold ..... 271/220

FOREIGN PATENT DOCUMENTS 196 26 577 A1 8/1998 (DE) .
406127794 A * 5/1994 (JP) ..... 271/220
403267265 * 11/1994 (JP) ..... 271/220

* cited by examiner

*Primary Examiner*—H. Grant Skaggs
(74) *Attorney, Agent, or Firm*—Foley & Lardner; Bernard L. Kleinke

(57) ABSTRACT

A device for collecting and aligning a stack of sheets of a recording medium is described, in which the particular uppermost sheet of the stack is pulled by a driven carrier finger toward an alignment stop. In order to hold the uppermost sheet of the stack when the next sheet is guided onto the stack, pressure rollers are provided which, during the feeding of the succeeding sheet onto the stack, can be lowered and for a further conveying of the stack can be pivoted off the latter.

4 Claims, 4 Drawing Sheets

DEVICE FOR COLLECTING AND ALIGNING A STACK OF SHEETS OF A RECORDING MEDIUM

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION

1. Technical Field

The field of the present invention is devices for collecting and aligning a stack of sheets of a recording medium.

2. Background Art

In the case of office machines, for example printers, copiers and the like, it is frequently necessary to collect the sheet-form recording medium to form a stack. This collected stack must be aligned in order to process the stack further, for example in order to clip it, to staple it, or to deposit it with or without offset in an output.

Others have addressed aligning sheets in a stack. For example, DE 2 363 224 discloses moving sheets against an alignment stop on a tray using elastic carrier fingers which are disposed on a rotatably driven shaft. However, in this device, when a next sheet is supplied to the stack, it can displace an uppermost, already deposited sheet. Through frictional engagement such engagement distributes the alignment of the uppermost sheet. Therefore, there exists a need for an improved device such that the alignment of the stack, which has been supplied sheets from a carrier, is not disturbed by subsequently supplied sheets.

SUMMARY OF THE INVENTION

There is therefore provided pressure means which can be placed onto the deposited stack and that can be raised from the stack. The pressure means are controlled such that the pressure means are placed onto the stack after the carrier has aligned the uppermost sheet supplied list of the stack. The pressure means thereby reliably secure the uppermost sheet of the stack alignment with an alignment stop while the next succeeding sheet is being supplied. This next succeeding sheet therefore does not displace the deposited uppermost sheet nor impair the uppermost sheet's aligned position. As soon as the next succeeding sheet is supplied, the pressure means are lifted again from the stack such that the carrier can pull this last supplied sheet toward the alignment stop and can align it on the stack. The pressure means are also lifted from the stack if this stack is moved further, for example in order to align the stack along the edges perpendicular to the alignment stop or in order to further convey the collected stack to further working modules or to an output stage.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figure 1:
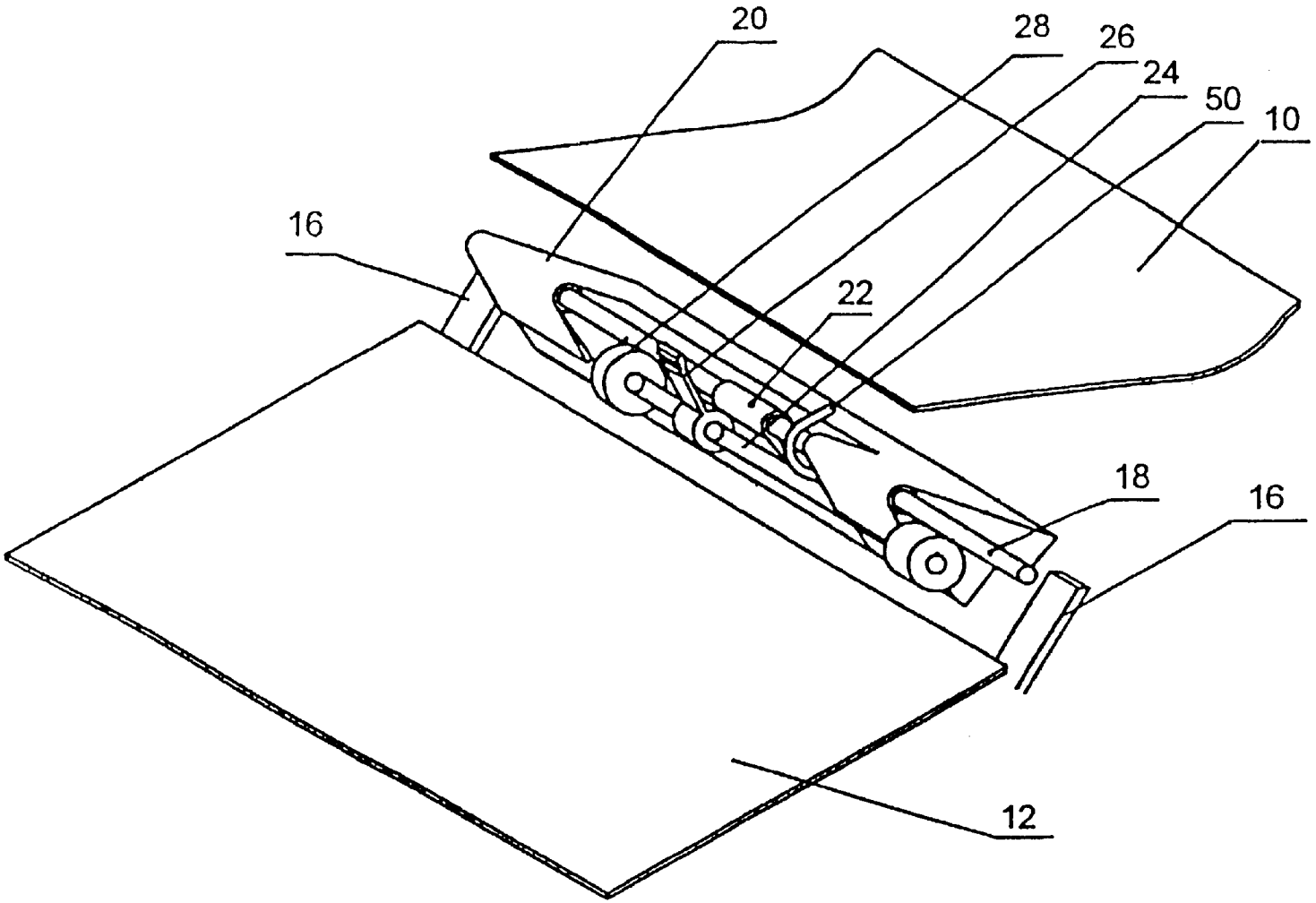
FIG. 1 is a diagrammatic perspective view of the device made in accordance with the present invention without the driving and control mechanisms.

Referring now to the drawings, there is shown a device for collecting and aligning a stack of sheets, which is made in accordance with the present inventions.

In the drawings only the parts of the device are depicted which are essential to the invention. The parts not shown are within the scope of prior known art and are familiar to a person skilled in the art. The device can be used in various office machines, such as printers, copiers and the like. Succeeding the device can be further working modules or an output unit, for example a sorter or the like.

The sheets 10 arriving from an office machine are supplied, in the representation of FIG. 1 from the right, and are deposited on a stack 12. The tray 14 for the stack 12 comprises an alignment stop 16 on which an edge, of the stack 12 is aligned.

A pivoted shaft 18 is rotatably supported in the casing (not shown) of the device. A pivotal arm 20 is supported on the pivotal shaft 12. A carrier lever 22 is disposed torsion-tight on the pivoted shaft 18 and engages the pivoted arm 20 such that the pivoted arm 20 is carried along and pivoted upon a rotational movement of the pivoted shaft 18.

An alignment shaft 24 is rotatably supported in the pivoted arm 20 and positioned eccentricity and axis-parallel to the pivoted shaft 18. On the alignment shaft 24 a carrier finger 26 is disposed torsion-tight. The carrier finger 26 projects substantially radially from the alignment shaft 24 and comprises an elastically flexible material, preferably a synthetic material which has sufficient adhering capability or is provided with an adhering coating such that the carrier finger 26 can come into fictional engagement with the stack 12. Further, on the alignment shaft 24 is disposed, freely rotatably, at least one pressure roller 28. The diameter of the pressure roller 28 and the radial length of the carrier finger 26 are dimensioned such that the carrier finger 26 projects radially beyond the circumference of the pressure roller 28. In FIG. 1, for the sake of clarity, only one carrier finger 26 and one pressure roller 28 are shown. It is apparent that in each instance two or more carrier fingers 26 and pressure rollers 28 can also be provided in order to effect a uniform advance and a uniform contact pressure of the particular sheet 10.

The pivoted shaft 18, the pivoted arm 20 and the alignment shaft 24 are disposed in the device such that the pivoted shaft 18 toward the alignment stop 16. The pivoting radius of the alignment shaft 24, with respect to the pivoted shaft 18, is dimensioned such that the carrier finger 26 and the pressure rollers 28 engage the stack 12 before the alignment stop 16 and can be pivoted onto the stack 12.

Figure 2:
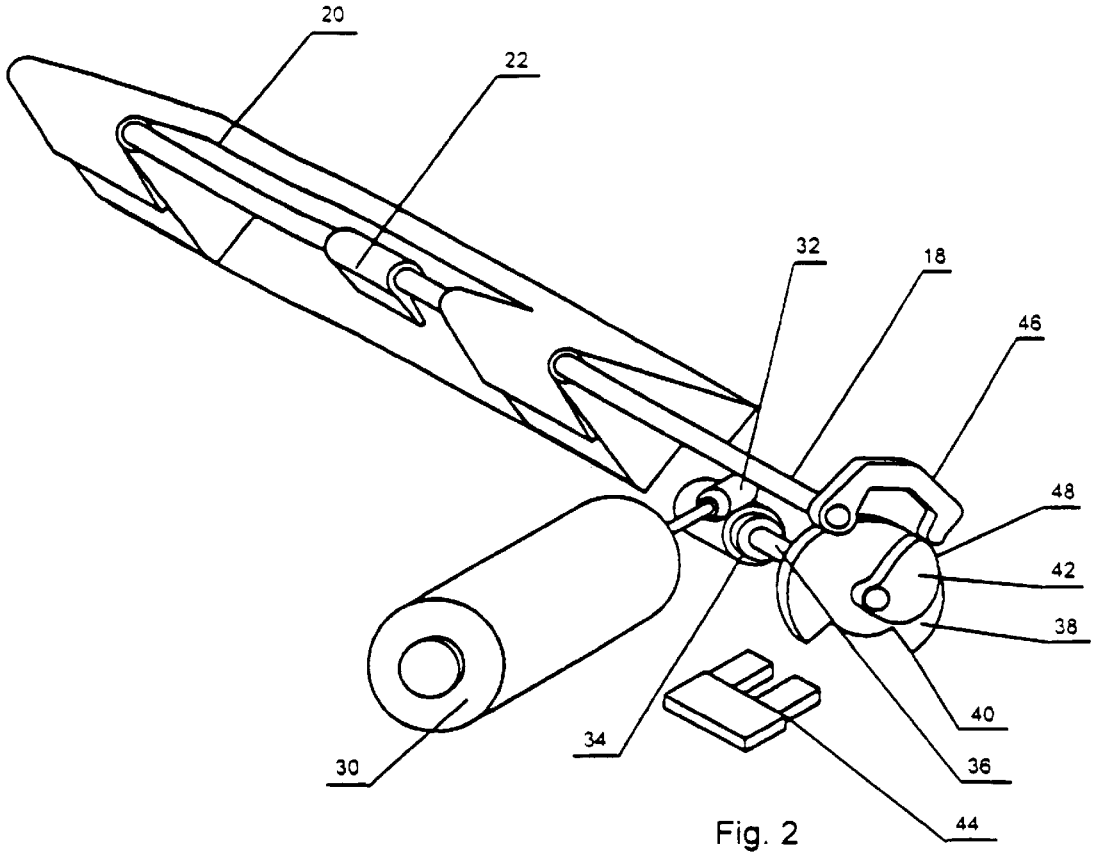
FIG. 2 is a partial diagrammatic representation of the device of FIG. 1, showing the control mechanisms.

The drive and the control of the pivoted arm 20 will be discussed in conjunction with FIG. 2. A motor 30, preferably a DC motor, device via a worm gear 32 and a helical gear 34 on shaft 36. Shaft 36 is axis-parallel to the pivot shaft 18. On the shaft 36 are disposed a cam disk 38 having a cut-out control sector 40 and, a cam plate 42. The cam disk 38 and its control sector 40 are scanned by a photosensor 44. Cooperating with the cam plate 42 is a follower lever 46 which is disposed torsion-tight on the pivoted shaft 18. The cam plate 42 extends over an angular range of approximately 30° to 60° and increases in this angular range with a control curve 48 radially to a maximum radius. If the follower lever 46 rises on this control curve 48 radially upward, the follower lever 46 is pivoted and rotates the pivoted shaft 18. The pivoted arm 20 which cooperates with the pivoted shaft 18 via the carrier lever 22, is also pivoted. Further the alignment shaft 24 is pivoted away from stack 12. Behind the cam plate 42 the follower lever 46 falls again radially inwardly whereby the pivoted arm 20 is pivoted with the alignment shaft 24 toward the stack 12. This pivot motion is supported by a spring 50 which engages the alignment shaft 24 or the pivoted arm 20.

Figure 3:
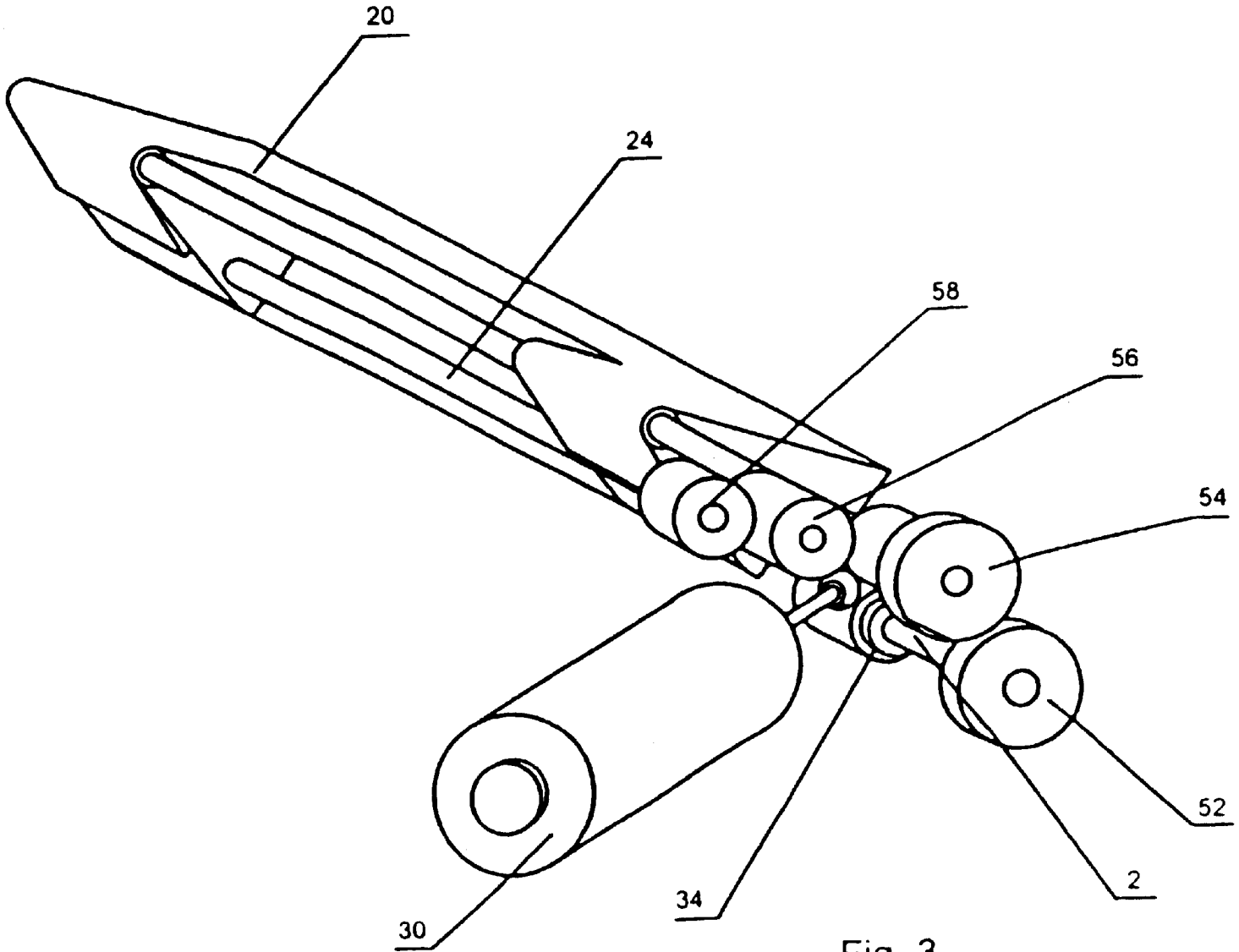
FIG. 3 is a partial diagrammatic representation of the device of FIG. 1 showing the driving mechanisms.

The driving mechanism of the alignment shaft 24 is partially shown in FIG. 3. The shaft 36 (driven by the motor 30) drives the alignment shaft 24 via a toothed gearing 52, 54, 56 and 58. This toothed gearing is dimensioned such that the teeth remain meshed during the pivot motion for the alignment shaft 24.

The operation of the device will now be discussed. The motor 30 drives the cam disk 38 and of the cam plate 42 in such a way that these rotate in the clockwise direction as shown in FIG. 2. The control sector 40 provides with its trailing edge via the photosensor 44 a control signal that the stack 12 is enabled. In such a manner, simultaneously with this control signal the follower lever 46 runs up on the control curve 48 of the cam plate 42 such that the pivoted arm 20 with the carrier finger 26 and the pressure rollers 28 is raised from the stack 12. Now a further sheet 10 can be aligned on the stack 12 or the stack 12 can be aligned laterally or can be conveyed further.

Figure 5:
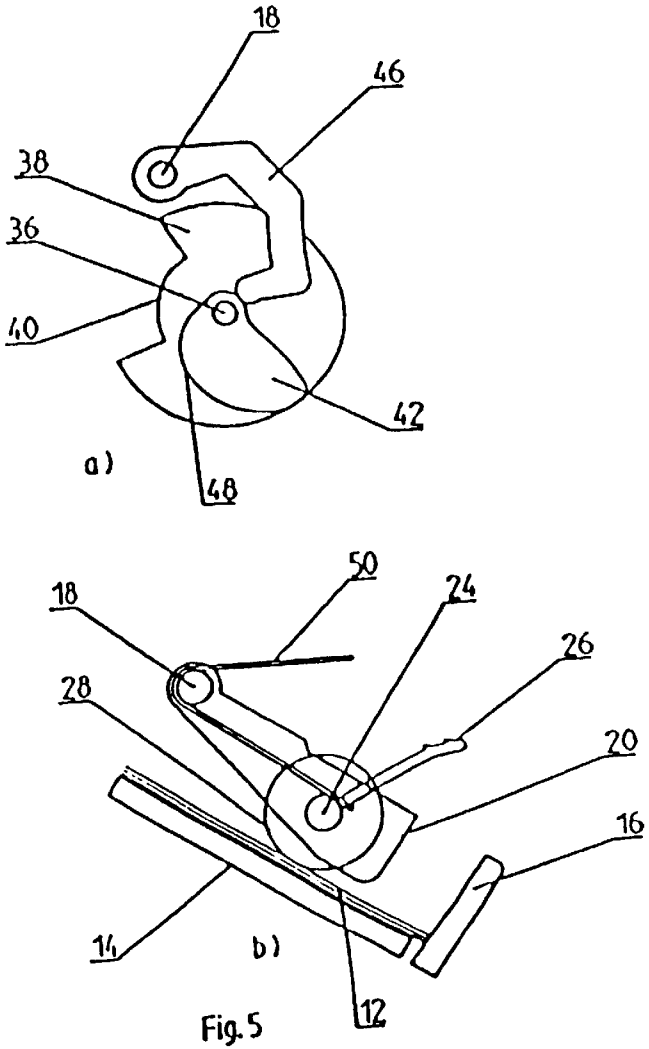
FIGS. 5*a* and 5*b* are representation of the pressure means according to FIG. 4 showing mounted pressure means.
Figure 4:
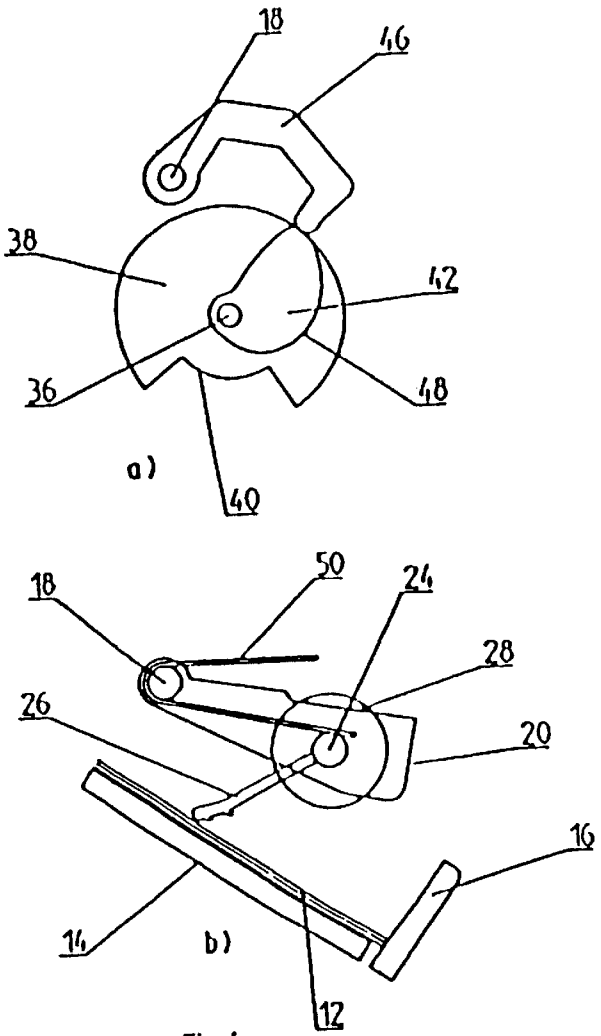
FIGS. 4*a* and 4*b* are an enlarged, schematic side view the raised pressure means for use or the device shown in FIG. 1.

If a further sheet 10 is supplied to the stack 12, it moves as shown, in FIG. 1, via the alignment mechanism onto stack 12. When the trailing rear edge of sheet 10 has passed the alignment mechanism, the carrier finger 26 has also rotated so far that it extends from above onto the rear edge of sheet 10, and with its further rotation pushes this rear edge toward stack 12 as is shown in FIG. 4*b*. In such a manner, the carrier finger 26 comes to rest with its free end on the sheet 10 and flexes such that, under its bending stress, it pushes against the sheet 10 and carries it under frictional engagement toward the alignment stop 16. At this point the follower lever 46 leaves the cam plate 42 and falls radially inwardly as is shown in FIG. 5*a*. The pivoted arm 20, with the alignment shaft 24 and under tension by the spring 50, is lowered toward the stack 12, as shown in FIG. 5*b*. Now, the pressure roller(s) 28, under the light force of spring 50, are in contact with the uppermost sheet 10 on stack 12. With the further rotation of the alignment shaft 24, the carrier finger 26 pulls the uppermost sheet of stack 12 toward the alignment stop 16. Subsequently, the carrier finger 26 is pulled away from the edge of the sheet to behind the alignment stop 16 so that no advancing force acts any longer on the uppermost sheet of stack 12. Further this uppermost sheet remains aligned on the alignment stop 16. The pressure rollers 28, which are disposed so as to be freely rotatable on the alignment shaft 24, do not hinder the alignment of the uppermost sheet of stack 12.

As soon as the control sector 40 of the cam disk 38 with its leading edge, in the drawing this is the left edge, reaches the photo sensor 44, the latter outputs the signal for supplying a further sheet. This next sheet 10 is supplied to the stack 12 from the right side as shown in the drawings. Previously, this sheet could have exert onto the uppermost sheet of the stack a frictional force which could move the uppermost sheet from the alignment stop 16. However, such force reliably prevented as the pressure rollers 28, under the force of spring 50, rest in contact on the uppermost sheet of stack 12 and retain the uppermost sheet on the stack 12. Only after the rear edge of the newly supplied sheet 10 has passed the alignment device, does the trailing right edge of the control sector 40 arrive at the photosensor or 44. Substantially simultaneously the cam plate 42 pivots, via the follower lever 46, the pivoted arm 20 away from the stack. Upon the corresponding signal of the photosensor 44, the stack 12, now enabled, can, if necessary, be moved further or the newly supplied sheet 10 can be pulled toward the alignment stop 16 by means of the carrier finger 26.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A device for collecting and aligning a stack of sheets of a recording medium, the stack being collected in a tray having an alignment stop, comprising:

at least one carrier positioned on a drivable alignment shaft, the carrier for frictionally engaging an uppermost sheet on the stack and moving the uppermost sheet toward the alignment stop with, pressure means positionable on the stack for holding the uppermost sheet of the stack in its alignment on the alignment stop while a next sheet is guided onto the stack; and lifting means for lifting the pressure means from the stack so that the stack can be moved, wherein the carrier and the pressure means are disposed on a common alignment shaft, the alignment shaft being pivoted by a pivot arm and the pivot arm being pivoted by means of a cam control, said device for collecting and aligning a stack further including control means for controlling a pivot motion of the pressure means, the control means having a signal indicating the lifting of the pressure means from the stack.

2. The device for collecting and aligning a stack according to claim 1, wherein the control means further includes a cam disk which is driven by a same shaft as the cam control.

3. A device for collecting and aligning a stack of sheets of a recording medium, the stack being collected in a tray having an alignment stop, comprising:

at least one carrier positioned on a drivable alignment shaft, the carrier for frictionally engaging an uppermost sheet on the stack and moving the uppermost sheet toward the alignment stop with, pressure means positionable on the stack for holding the uppermost sheet of the stack in its alignment on the alignment stop while a next sheet is guided onto the stack; and lifting means for lifting the pressure means from the stack so that the stack can be moved, wherein the at least one carrier is disengaged from the uppermost sheet on the stack while the next sheet is guided onto the stack.

4. A method for collecting and aligning a stack of sheets of a recording medium, the stack being collected in a tray having an alignment stop, comprising:

engaging an uppermost sheet on the stack and moving the uppermost sheet toward the alignment stop with at least one carrier positioned on a drivable alignment shaft;

holding the uppermost sheet of the stack in its alignment on the alignment stop with at least one pressure roller positionable on the stack while a next sheet is guided onto the stack;

lifting the at least one pressure roller from the stack so that the stack can be moved; and disengaging the at least one carrier from the uppermost sheet while the next sheet is guided onto the stack.

* * * * *